United States Patent [19]

Turini

[11] 4,163,893

[45] Aug. 7, 1979

[54] TONER FIXING ARRANGEMENT IN ELECTROSTATIC PRINTERS AND COPIERS

[75] Inventor: Gerhard Turini, Maisach, Fed. Rep. of Germany

[73] Assignee: Siemens Aktiengesellschaft, Berlin & Munich, Fed. Rep. of Germany

[21] Appl. No.: 845,395

[22] Filed: Oct. 25, 1977

[30] Foreign Application Priority Data

Feb. 11, 1977 [DE] Fed. Rep. of Germany ..... 2705893

[51] Int. Cl.[2] ..... H05B 1/00; G03G 15/20

[52] U.S. Cl. ..... 219/216; 219/388; 219/469

[58] Field of Search ..... 219/216, 388, 469–471; 355/3 FU; 432/60, 228, 8, 59, 227

[56] References Cited

U.S. PATENT DOCUMENTS

| | | | |
|---|---|---|---|
| 3,324,791 | 6/1967 | Cassano et al. | 355/14 X |
| 3,452,181 | 6/1969 | Stryjewski | 219/216 |
| 3,810,776 | 5/1974 | Banks et al. | 219/388 |
| 3,811,821 | 5/1974 | Ariyama et al. | 219/216 X |
| 3,833,790 | 9/1974 | Quant et al. | 219/216 |
| 3,849,628 | 11/1974 | Abowitz et al. | 219/216 |
| 3,861,863 | 1/1975 | Kudsi | 432/60 |
| 3,951,585 | 4/1976 | Fujimoto | 219/469 X |
| 4,038,026 | 7/1977 | Wada et al. | 219/469 X |

*Primary Examiner*—C. L. Albritton

*Attorney, Agent, or Firm*—Hill, Van Santen, Steadman, Chiara & Simpson

[57] ABSTRACT

A toner fixing station in an electrostatic copier includes a heated fixing drum and an opposed pressure cylinder. A preheat arrangement is provided for the pressure cylinder to bring the pressure cylinder up to an operating temperature prior to biasing it into opposition to the fixing drum.

9 Claims, 1 Drawing Figure

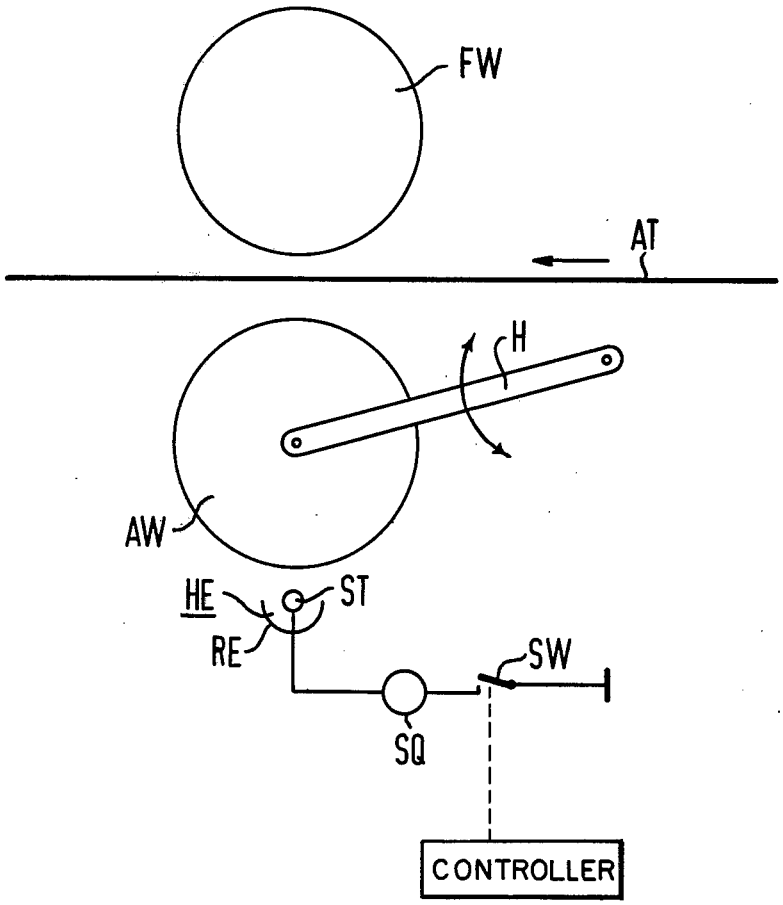
FW
AT
H
AW
HE
ST
RE
SW
SQ
CONTROLLER

TONER FIXING ARRANGEMENT IN ELECTROSTATIC PRINTERS AND COPIERS

BACKGROUND OF THE INVENTION

1. Field of the Invention

This invention relates to electrostatic copiers and printers and more particularly to a toner fixing arrangement within such devices. 2. Prior Art This invention is directed to that class of device, hereinafter referred to as a copier, wherein a toner image is produced on a data carrier in a nonmechanical printer or copier and wherein the data carrier passes between a heated fixing cylinder and a pressure cylinder which biases the data carrier into contact with the fixing cylinder. The toner image is fused onto the data carrier by heat.

Nonmechanical printers and copiers of this type are known to the art. See for example U.S. Pat. No. 3,861,863. In such devices toner images of the character or symbol to be printed are produced on a data carrier, for example a paper web.. This can be accomplished by forming latent images or charged images of the character or symbol on a photoelectric or dielectric intermediate carrier by electrophotographic or electrographic processes. The intermediate carrier may for example be a drum. The latent images are then developed at a developing station by application of toner. Application of the toner forms a toner image on the intermediate carrier in areas defined by the latent image. The toner image can then be transferred to the data carrier at a transfer station. In order to insure that the transferred toner image does not thereafter blur, the toner image is subsequently fused onto the data carrier at a fixing station.

Fixing stations at which toner images are fused onto the data carrier are already known. See for example U.S. Pat. Nos. 3,861,863 or 3,324,791, the teachings of which are herein incorporated. In these known fixing devices, the data carrier passes between a heated fixing cylinder and a pressure cylinder. The pressure cylinder biases the data carrier into contact with the fixing cylinder. As the data carrier passes between the cylinders, the toner image on the data carrier faces towards the fixing cylinder. By the application of heat and pressure at the fixing station, the toner image will be fused onto the paper web. The pressure cylinder is normally pivotable towards and away from the fixing cylinder such that the pressure cylinder can be brought into contact with the fixing cylinder or can be positioned out of contact. Such a pivoting pressure cylinder is disclosed in U.S. Pat. No. 3,861,863.

In prior fixing stations of the type herein discussed, only the fixing cylinder is heated. The pressure cylinder is heated up during usage of the electrostatic copier because a portion of the heat of the fixing cylinder will be transferred to the pressure cylinder during the fixing operation. This means, however, that the pressure cylinder only heats up slowly and it may take some considerable period of constant operation before a pressure cylinder which is cold at copier start up is brought to a temperature approximating that of the fixing cylinder.

This has now been determined to be a major drawback because the heat differential between the cylinders is capable of causing the formation of creases in the paper web. Further because of this the characters printed on the paper web may become blurred which can create a serious problem, particularly where the characters may later be subjected to machine reading.

DESCRIPTION OF THE PREFERRED EMBODIMENT

It is therefore a primary object of this invention to provide a device for fixing toner images on data carriers which device will not cause creasing of the data carrier during the fixing operation.

This primary object is achieved by providing a preheater device in association with the pressure cylinder which will preheat the pressure cylinder when the copier has been turned on. The preheater is turned off during toner image fixing.

By provision of the preheat device the temperature of the pressure cylinder will be raised, prior to the commencement of copying or printing to a point which is sufficiently high to insure that a data carrier passing between the fixing cylinder and the preheated pressure cylinder will not be adversely affected due to any temperature differential between the cylinders. Thus, in a preferred embodiment, the preheat device can be turned on when the copier or printer is switched on and then can be turned off when the fixing cylinder, which is also being heated at the same time, has reached its operating temperature.

It has been found convenient if the pressure cylinder rotates during the preheat operation. This will insure that all areas of the pressure cylinder will be uniformly heated.

Since during protracted printing periods the pressure cylinder will maintain proper heat level because of heat transfer from the fixing cylinder, it is not necessary that the preheat device operate other than at copier start up. However, particularly in connection with intermittently operated devices, such as electrostatic copiers, it may be desirable to provide for reheating of the pressure cylinder during noncopying periods.

It is therefore an object of this invention to provide an improved electrostatic copying or printing device.

It is another object of this invention to provide an improved toner fixing station for electrostatic copiers.

It is yet another and more specific object of this invention to provide an improved toner fixing station for electrostatic copiers utilizing a fixing roller and an opposed pressure roller which is preheated.

It is another specific object of this invention to provide a fixing station for electrostatic copiers having a heated toner fixing roller opposed by a pressure roller pivotable between a fixing position and a rest position spaced from the fixing position with a preheater for the pressure roller at the rest position.

It is another specific object of this invention to provide a toner fixing station for electrostatic copiers having a pressure roller pivotable between a fixing position in pressure opposition to a fixing roller and rest position spaced from the fixing position with a pressure roller preheating device operable at the rest position to preheat the pressure roller and switch means effective to activate the preheat device at least upon start up of the copier prior to copying operation initiation.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

BRIEF DESCRIPTION OF THE DRAWING

The FIGURE schematically illustrates the fixing station of an electrostatic copier according to this invention.

DESCRIPTION OF THE PREFERRED EMBODIMENT

The FIGURE illustrates, in a schematic or diagrammatic drawing of a fixing station, the herein invention. The drawing does not proport to show in detail such a fixing station in that it is assumed that the structure of the fixing cylinder with its associated heating elements etc. are well known from existing literature. Further the overall structure of the pressure cylinder and its associated pivoting mechanism and pivot actuating mechanisms are well known per se and are, for example, shown in the aforementioned U.S. patents.

Therefore, in the FIGURE only that part of the fixing station which is essential to an explanation of the invention has been shown. The other parts of the fixing station can be determined from the patents previously referenced. Thus, the FIGURE illustrates a fixing cylinder FW and, adjacent and opposed to it, a pressure cylinder AW. The pressure cylinder AW is rotatably mounted on a lever H which is used to show that the pressure cylinder can be rotated from a first or rest position in which it is not in abutment with the fixing cylinder FW into a fixing or second position in which it is in abutment with, or in which it presses a data carrier AT into contact with, the fixing cylinder FW. Construction of the pressure cylinder AW may be substantially as previously indicated in the art.

In order to heat the pressure cylinder AW before commencement of the printing or copying operation, a heating device HE is provided. The heating device can, for example, consist of a short wave or long wave infrared radiator ST disposed within a reflector RE. The reflector and radiator are positioned adjacent the position of the pressure cylinder AW when it is in the rest position. When the electrostatic copier is turned on, the radiator ST will also be switched on and will heat up the pressure cylinder AW. During this period of time the pressure cylinder AW rotates and may, for that purpose, be motor driven having a motor control or gearing which is associated with the control for the heating device to the extent that the motor will be operated whenever the heating device HE is functioning.

When the pressure cylinder AW has been sufficiently heated, the heating device HE will be shut off. The shutoff control for the heating device HE may, for example, be tied in with the temperature control for the fixing roll or cylinder FW which is also being heated in the time period immediately after turning on of the electrostatic copying device. To this end, the fixing cylinder FW may be equipped with thermostat means sensing its heated temperature which thermostat means can be used to shut off or otherwise control the heating device HE. Further, preferably, the heating device HE is arranged to shut off when copying commences. During copying or printing the heating device HE remains in an inactive state since sufficient heat will be transferred through the data carrier AT from the fixing cylinder FW to maintain temperature of the pressure AW.

Thus, at commencement of printing, the pressure cylinder will have acquired a temperature sufficient to insure that when the data carrier AT is pressed into contact with the fixing cylinder FW, creases will not be formed in the data carrier due to a temperature differential between the cylinders. During printing, heat transfer to the pressure cylinder AW from the fixing cylinder FW will occur thus assuring that no crease causing temperature differential will be created.

In those instances where the electrostatic copier undergoes an interrupted printing operation, the pressure cylinder AW will be swung away to the rest position. Generally the heat radiated by the fixing cylinder will be sufficient to maintain the pressure cylinder AW at a relatively warm temperature sufficient to prevent creasing upon reoccurrence of the printing operation. However should the pressure cylinder remain pivoted away from the fixing cylinder for an appreciable period of time such that its temperature begins to drop, then it may be desirable to switch the preheater device back on again.

Control for the operation of the heater device HE can be in any one of a number of known ways. For example, in the connecting lead line between a voltage source SQ and the radiator ST, it is possible to position a switch SW which is closed by the operator when the copying unit is switched on. The switch may be such as to open again when the fixing cylinder FW has reached its operating temperature or when a predetermined time period has lapsed. Circuits which measure the temperature of the fixing cylinder FW are also well known. In addition, in order to provide for heating during intermittent printing when necessary, temperature sensing devices may be positioned in proximity to the pressure cylinder rest position to sense its temperature. Known sensing devices can be employed and for that reason no specific such sensing device is herein described. Such known sensing devices, include thermostats and the like which can be arranged either in series or in parallel with the switch SW and it should be apparent that, if desired, the switch SW can be tied to the movement of the pressure cylinder from the rest position to the fixing position where it biases the recording carrier AT into contact with the fixing cylinder FW. In that instance, the switch SW will be open when the pressure cylinder AW is not in the rest position. If the switch SW is in series with a temperature responsive switch associated with the fixing cylinder FW, it can be assured that the heating device HE will only operate when the fixing cylinder FW is being heated. Other variations of control means for the heating unit HE will be readily apparent to those skilled in the art.

It can therefore be seen from the above that this invention provides a supplemental preheater for electrostatic copying devices which is used in association with the pressure cylinder of the fixing station to bring the pressure cylinder up to a desired temperature prior to start of the fixing operation in order to insure that there will not be a large temperature differential between the pressure cylinder and its opposed heated fixing cylinder.

Although the teachings of my invention have herein been discussed with reference to specific theories and embodiments, it is to be understood that these art by way of illustration only and that others may wish to utilize my invention in different designs or applications.

I claim as my invention:

1. In a fixing device for fixing a toner image applied to a data carrier in electrostatic copying device wherein the fixing device includes a heated fixing cylinder and an opposed pressure cylinder biasing the data carrier into contact with the fixing cylinder to fuse a toner image on the data carrier by application of heat, the improvement of a preheating device positioned adjacent a rest position of the pressure cylinder, activating control means for the preheating device effective to preheat the pressure cylinder upon start up of the copier device, the preheat device being deactivated during a toner fusing operation.

2. A device according to claim 1 wherein shut off control means are provided to deactivate the preheating device when the heated fixing cylinder has reached a normal operating temperature.

3. A device according to claim 1 wherein shut off control means are provided to deactivate the preheating device when a predetermined time period of preheating device activation has elapsed.

4. A toner fixing station for an electrostatic copying device wherein toner images applied to a recording carrier are fused onto a recording carrier by application of heat and pressure comprising: a pair of opposed cylinders, one of said cylinders being a heated fixing cylinder disposed on a side of the recording carrier upon which the toner image is positioned, the other cylinder being a pressure cylinder, the pressure cylinder being pivotable from a fixing position adjacent the fixing cylinder to a rest position spaced from the fixing cylinder, a preheating device within said copying device adjacent said rest position, said preheating device effective to preheat said pressure cylinder when the said pressure cylinder is in the rest position.

5. The device of claim 4 wherein control means are provided for controlling actuation of the preheating device.

6. The device of claim 5 wherein the control means actuates the preheating device upon the start up of the copier.

7. The device of claim 6 wherein the control means is effective to terminate activation of the preheat device when the fixing cylinder has been heated to an operating temperature.

8. The device of claim 6 wherein the preheating device is deactivated during periods when the pressure cylinder is in the fixing position.

9. The device of claim 8 wherein the preheating device is an infrared radiator.

* * * * *